United States Patent [19]

Cugini

[11] 3,967,657

[45] July 6, 1976

[54] WEFT CONTROL DEVICE

[75] Inventor: John A. Cugini, Hopedale, Mass.

[73] Assignee: Rockwell International Corporation, Pittsburgh, Pa.

[22] Filed: Jan. 22, 1976

[21] Appl. No.: 651,444

[52] U.S. Cl. ..... 139/450; 139/453; 242/150 R

[51] Int. Cl.[2] ..... D03D 47/34

[58] Field of Search ..... 139/116, 429, 450, 452, 139/453; 66/125; 242/147 R, 149, 150 R, 155 R, 156

[56] References Cited

UNITED STATES PATENTS

| | | | |
|---|---|---|---|
| 2,429,394 | 10/1947 | Clairmont | 139/453 |
| 3,269,426 | 8/1966 | Llado | 139/450 |

FOREIGN PATENTS OR APPLICATIONS

| | | | |
|---|---|---|---|
| 218,535 | 1/1968 | Sweden | 139/450 |
| 396,961 | 8/1933 | United Kingdom | 139/453 |

*Primary Examiner*—Henry S. Jaudon

[57] ABSTRACT

A weft control device for shuttleless looms of the type having a pair of spring biased disc elements between which the weft is advanced for insertion into sheds of warp threads. The device is located intermediate the source of weft and the edge of the fabric being formed, and includes a driving apparatus for effecting rotation of the disc elements in a direction that will apply tension to the weft and automatically recover the development of any slack therein in the area intermediate the disc elements and the fabric edge.

4 Claims, 3 Drawing Figures

WEFT CONTROL DEVICE

BACKGROUND OF THE INVENTION

1. Field of the Invention

The invention relates to shuttleless looms wherein weft yarn is supplied from a stationary source and is inserted into sheds of warp threads by opposed carrier members that are attached to the free end of flexible tapes which are alternately wrapped about and extended from oscillating tape wheels located at each side of the loom. In timed sequence with the weaving cycle the weft yarn is acted upon by a presenting member which locates the weft in a position for reception by a so-called inserting carrier which carries said weft into the shed and presents it to a so-called extending carrier that draws the weft through the remainder of the shed to complete a single pick. In particular the invention pertains to an improved device for assuring positive positioning of the weft for reception into the inserting carrier by tensioning and preventing the development of slack in said weft in the area adjacent the edge of the fabric being formed.

2. Description of the Prior Art

Shuttleless looms to which the present invention is applicable can be of the type in which weft is supplied from one or more sources or which may employ either the Gabler or Dewas system of weft insertion. In such looms, a weft presenting member is actuated in timed sequence with the weaving cycle so as to locate said weft in a position where it will be received into and taken by the inserting carrier into a shed for presentation to the weft extending carrier.

Spring biased disc-type yarn tensioning devices are well known and have been utilized on shuttleless looms as well as vertically disposed spring biased friction plates such as shown and described in U.S. Pat. No. 3,561,488. These known types of tensioning devices are fixed on the loom and located intermediate the weft presenting member or members and the source or sources of weft supply. The known forms of weft tensioning devices have not been completely satisfactory in maintaining a positive tension on the weft in the area intermediate said devices and the edge of the fabric being formed. Relative to this particular area, many complaints were received on loss of tension and the development of slack in the weft which in many cases was sufficient to prevent the presenting member from properly locating the weft for reception by the inserting carrier. With the development of slack in the weft in the area intermediate the tensioning device and the fabric edge there is no way to recover the lost tension and will result in a cessation of loom operation due to lack of weft. The development of slack in the weft as described above can be caused in a number of ways such as dancing or linear movement of the presenting member which will actually withdraw a slight amount of weft from its source and when attempting to locate said weft for reception by the inserting carrier the slackness therein will cause the weft to be lowered beyond the carrier pick-up position. Vibration of the various loom elements during loom operation has frequently been responsible for loss of tension of the weft. Overhead air cleaners for removing lint from a loom have caused loss of tension on certain types of weft yarns which must be withdrawn from their source under a minimum amount of tension due to the strength thereof and the type of fabric being woven. Another cause of loss of tension to the weft is movement of the lay beam during beat-up of a pick which will actually pull a slight amount of weft through the tensioning device and create enough slack therein so as to effect a change in the position in which the presenting member places it for pick-up by the inserting carrier. It is very important that the weft yarn be precisely located when presented to the inserting carrier for the weft pick range of the latter is quite narrow and a small deviation in this position frequently results in failure to insert the intended pick.

A still further cause for loss of weft tension is the build-up of lint or other foreign matter between the spring biased elements through which the weft passes and which are intended to tension said weft.

The weft control device of the present invention has overcome the problems described above by providing a weft control device of the self-cleaning type which applies and maintains a predetermined amount of tension to the weft and assures positive positioning of the latter for presentation to the inserting carrier.

SUMMARY OF THE INVENTION

The weft control device according to the invention is of the opposed disc type in which a weft yarn is drawn between a pair of discs individual thereto. An adjustable biasing means continuously urges one disc toward the other and is set to apply a predetermined amount of tension on the weft. A separate pair of discs are provided for each source of weft yarn and are all mounted on a common shaft that is rotatably supported on the loom intermediate the sources of weft yarn and the presenting members for positioning a selected weft to the inserting carrier.

A drive means is operatively connected to the shaft on which the discs are mounted and is continuously rotated during loom operation. The manner in which the discs are mounted on this shaft causes them to rotate therewith and as seen looking from the front of the loom rotation of said discs is in a clockwise direction. By rotating the discs in this manner a directional force, opposite to the direction of feed of said weft, is applied to the latter and is effective in maintaining the weft relatively taut in the area intermediate said discs and the fabric being formed as well as immediately recovering any slack that should develop in this area for reasons heretofore described. Additionally the combination of the rotating discs and the weft yarn extending therebetween creates a wiping action which prevents the accumulation of lint or other foreign matter between said discs.

It is a general object of the invention to provide a weft control device for shuttleless loom for assuring the positive positioning of a selected weft yarn for reception by the inserting carrier.

A further object is to provide an improved weft control device for shuttleless looms for maintaining tension on the weft in the area where it is presented for insertion into a warp shed and which will automatically recover any slack that a weft yarn may develop in this area.

Another object is to provide an improved weft control device of simplified construction, having a minimum number of parts which are relatively inexpensive to manufacture and with long life expectancy.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
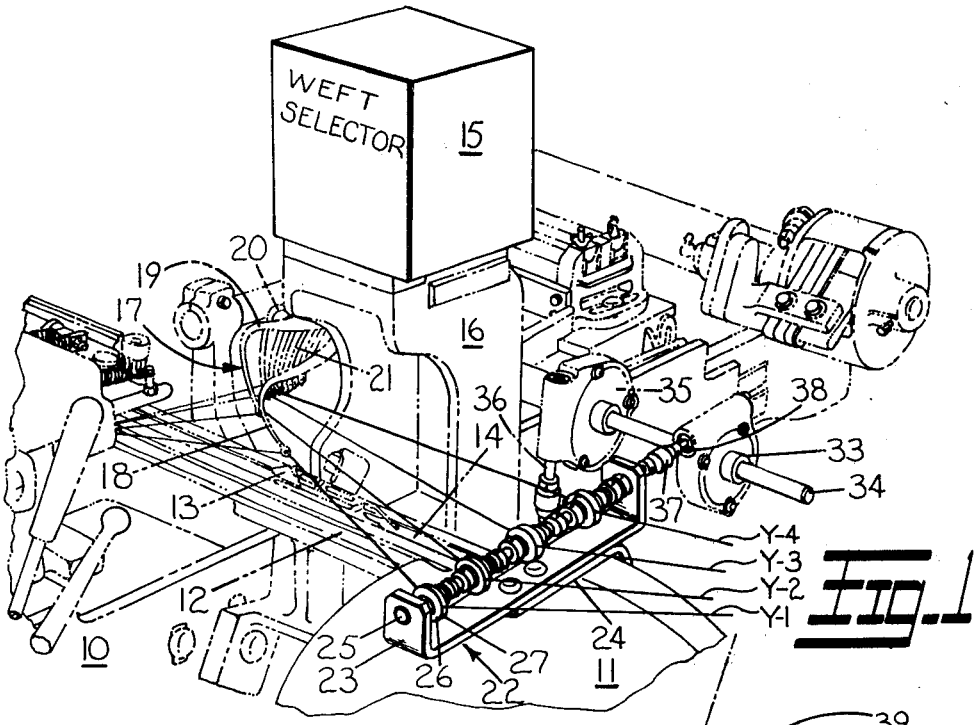
FIG. 1 is a perspective view of a portion of a shuttleless loom showing the weft control device according to the invention applied thereto.

Now referring to the figures of drawing enough of a shuttleless loom is shown in FIG. 1 to serve as a basis for a detailed description of the invention applied thereto.

In FIG. 1 the forward upper right hand end of a shuttleless loom is shown and among the various parts thereof there is shown a portion of the framework at 10, the right hand tape wheel housing 11 from which extends the usual tape guide 12. The weft inserting carrier is depicted by numeral 13 and as is well known to those conversant in the weaving art, said carrier is fixed on the end of a tape 14, which in the performance of its intended function is caused to be wrapped about and unwrapped from a tape wheel (not shown) that is oscillatably driven within the housing 11.

A weft selector unit 15 is diagrammatically shown in FIG. 1 and is carried on the upper surface of a support stand 16 which is assembled to the framework 10 by a suitable means not shown.

A plurality of weft presenting members or yarn fingers generally indicated by numeral 17 are operatively associated with the selector unit 15. In accordance with the predetermined pattern the yarn fingers are selectively and independently moveable to locate a particular weft yarn individual thereto in an inactive position or one of which the weft will be taken by the inserting carrier and presented to a companion carrier within the shed of warp threads. In FIG. 1 four separate weft yarns are shown which are drawn from independent sources (not shown) and are identified by Y-1, Y-2, Y-3 and Y-4. The yarn fingers for positioning weft yarns Y-1, Y-2, Y-3 and Y-4 are identified by numerals 18, 19, 20 and 21 respectively.

Figure 3:
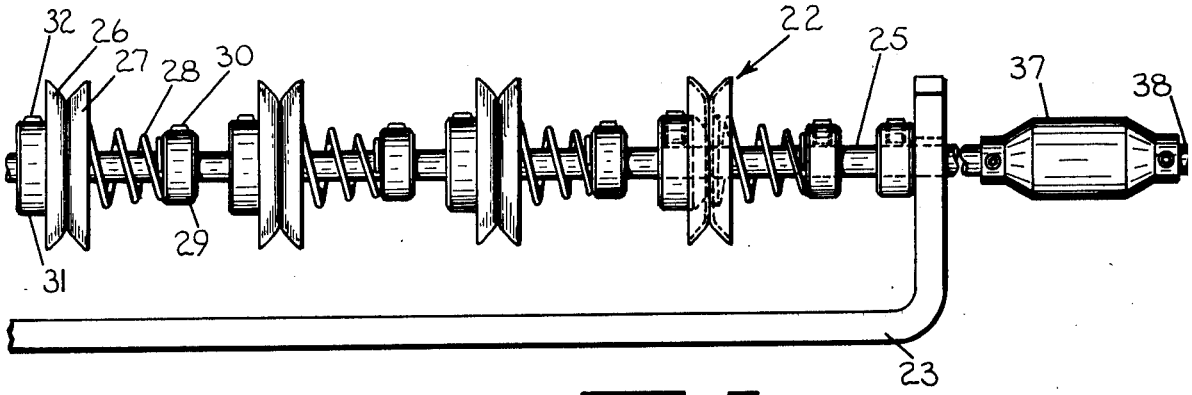
FIG. 3 is a view in side elevation and on an enlarged scale showing further detail of weft control device.

The weft control device according to the invention is identified generally in FIGS. 1 and 3 by numeral 22. This device includes an elongated U-shaped mounting bracket 23 which is fixed on the loom intermediate the yarn fingers and sources of weft by means of a support member 24. A shaft 25 is rotatably carried in the mounting bracket 23.

As shown in FIGS. 1 and 3 shaft 25 has a pair of disc members for each source of weft yarn assembled thereon with each pair including individual positioning and biasing means associated therewith. As each of these pairs of disc elements are alike and include the same elements for biasing and locating them of shaft 25 is is only considered necessary for purpose of brevity to describe that pair of discs for controlling weft yarn Y-1. The discs for weft yarn Y-1 are identified by numerals 26 and 27 and are disposed in contiguous relation on shaft 25. Disc 27 is continuously urged into frictioned contact with disc 26 by means of a coil spring 28 which is assembled on shaft 25 in a slightly compressed manner. One end of this spring 28 is in contact with a collar 29 that is fixed on shaft 25 by means of a set screw 30, and the opposite end is in contact with disc 27. Disc 26 is prevented from moving longitudinally on shaft 25 by means of a collar 31 which is fixed on said shaft by means of a set screw 32. Shaft 25 is rotatably driven as will be described hereinafter and the biasing force of coil spring 28 for continuously urging disc 27 into contact with disc 26 is sufficient to cause both said discs to rotate with said shaft.

With reference to FIG. 1 the means for rotating shaft 25 includes a gear case 33 carried on the loom's so-called binder shaft 34. Shaft 34 is rotated by the gearing (not shown) contained within a gear case 35 which are driven from a suitable source of rotary motion (not shown) by means of a downwardly directed driving member 36. The gearing (not shown) within gear case 33 are rotated by the binder shaft 34 and this rotary movement is transmitted to shaft 25 by means of its connection to said gear case 33 which includes a coupling 37 and gear shaft 38.

Figure 2:
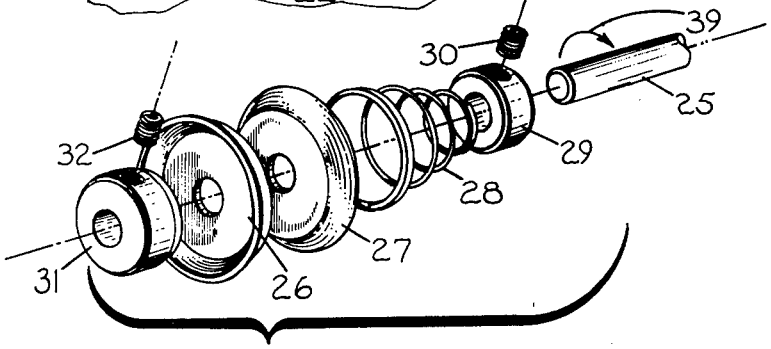
FIG. 2 is a perspective view in exploded form of one of the plurality of pairs of discs shown in FIG. 1.

Shaft 25 is rotated in the direction of the indicating arrow 39 in FIG. 2 which in turn rotates each of the pairs of discs in a clockwise direction as seen looking from the front of the loom. In FIG. 1 four pairs of disc members are shown which are utilized to control four separate sources of weft and it should be understood that a greater or lesser number of such pairs of discs can be utilized to accommodate whatever number of separate wefts that may be required to weave a desired type fabric.

To summarize the operation, the separate weft yarns Y-1, Y-2, Y-3 and Y-4 extend from their sources of supply through suitable guide elements (not shown), and thence between the pair of disc members individual thereto which are carried on shaft 25 of the weft control device 22. From the pairs of disc members each weft yarn passes through an eyelet formed in the particular yarn finger which is adapted to selectively move said weft yarns between their so-called active and inactive positions. From the eyelets in the yarn fingers the weft yarns extend to the edge of the fabric (not shown) where they are held in a manner well known to those conversant in the art of shuttleless weaving.

Each of the weft yarns extend between their particular pair of discs in the area above the shaft 25 which as seen looking from the front of the loom is caused to rotate in a clockwise direction. The means by which the pairs of discs are mounted on shaft 25 is combination with the biasing force for continuousing urging one of each pair of discs toward the other of each pair is effective in causing said pairs of discs to rotate with said shaft 25. Rotation of the pairs of discs in this manner in combination with the forces for urging said pairs of discs together applies a directional force to each weft yarn in a direction opposite to their direction of withdrawal from their sources. This directional force upon each weft yarn is effective in maintaining them relatively taut in the area intermediate the pairs of discs and the edge of the fabric to which they are connected. Additionally the rotating discs are effective in immediately recovering any slack which may develop in this area and the weft yarns extending between said rotating discs creates a wiping action which prevents any possible accumulation of lint or other foreign matter therebetween.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A weft control device for looms of the shuttleless type wherein weft from a stationary source is presented to an inserting member and inserted into sheds of warp threads, said device comprising:

a. a support means fixed on the loom;

b. means defining a pair of disc elements rotatably mounted in said support means to receive the weft therebetween;

c. biasing means for continually urging at least one of said disc elements into yielding contact with the other and the weft associated therewith; and d. drive means for rotating said disc elements in a direction to apply tension to the weft in the area intermediate said disc elements and the edge of the fabric being formed.

2. The weft control device according to claim 1 wherein said support means includes an elongated bracket member having a rod member rotatably mounted thereon upon which said disc elements are assembled.

3. The weft control device according to claim 2 wherein said biasing means includes a coil spring having one end fixed for rotation with said rod member and the opposite end in yieldable contact with one of said disc elements.

4. The weft control device according to claim 2 wherein said drive means includes a rotatably driven shaft with gear means operatively connecting the latter with said rod member.

* * * * *